US007951286B2

(12) United States Patent
Dwars et al.

(10) Patent No.: US 7,951,286 B2
(45) Date of Patent: May 31, 2011

(54) USING AN IMPRESSED CURRENT CATHODIC PROTECTION SYSTEM TO POWER ELECTRICAL APPLIANCES

(75) Inventors: Sicco Dwars, Chester (GB); Christopher Ozemoya Ubuane, Rijswijk (NL)

(73) Assignee: Shell Oil Company, Houston, TX (US)

( * ) Notice: Subject to any disclaimer, the term of this patent is extended or adjusted under 35 U.S.C. 154(b) by 321 days.

(21) Appl. No.: 12/298,114

(22) PCT Filed: Apr. 20, 2007

(86) PCT No.: PCT/EP2007/053870

§ 371 (c)(1),
(2), (4) Date: Oct. 22, 2008

(87) PCT Pub. No.: WO2007/122186

PCT Pub. Date: Nov. 1, 2007

(65) Prior Publication Data

US 2009/0078585 A1 Mar. 26, 2009

(30) Foreign Application Priority Data

Apr. 26, 2006 (EP) ..... 06113159

(51) Int. Cl.
*C23F 13/20* (2006.01)
*C23F 13/22* (2006.01)

(52) U.S. Cl. ..... 205/730; 205/731; 205/734; 205/735; 205/740; 205/725; 204/196.21; 204/196.36; 204/196.37; 204/196.02; 204/196.06

(58) Field of Classification Search ..... 204/196.21, 204/196.36, 196.37, 196.02, 196.06; 205/724, 205/725, 726, 727, 740, 730, 731, 734, 735
See application file for complete search history.

(56) References Cited

U.S. PATENT DOCUMENTS 6,715,550 B2 4/2004 Vinegar et al. ..... 166/250.15
2005/0258974 A1 * 11/2005 Mahowald ..... 340/632

FOREIGN PATENT DOCUMENTS

JP 9003668 1/1997
JP 2003253479 9/2003
WO WO0155555 8/2001

OTHER PUBLICATIONS

International Search Report dated Jan. 31, 2008 (PCT/EP2007/053870).

* cited by examiner

*Primary Examiner* — Bruce F Bell
(74) *Attorney, Agent, or Firm* — William E. Hickman

(57) ABSTRACT

A method is disclosed for using an impressed current cathodic protection (ICCP) system that supplies an electrical current such that a metallic structure (10) has a negative voltage of between 0.5 and 1.5 Volt relative to earth to power one or more electrical appliances (5), the method comprising: —providing one or more electrical appliances (5) which each have a pair of electrical contacts (1,2); —connecting one electrical contact (1) of each electrical appliance to the structure; and —connecting the other electrical contact (2) of each electrical appliance to earth, thereby providing electrical power to each of the electrical appliances. It is preferred that the electrical appliances (5) are equipped with one or more DC-DC power converters (6) which are configured to enhance an electrical input voltage of between 0.5 and 1.5 Volt to an electrical output voltage of between 3 and 5 Volt.

10 Claims, 3 Drawing Sheets

Multiple H bridge switched capacitor section. Typical value for n is 10

USING AN IMPRESSED CURRENT CATHODIC PROTECTION SYSTEM TO POWER ELECTRICAL APPLIANCES

PRIORITY CLAIM

The present application claims the priority to European Patent Application No. 06113159.5 filed 26 Apr. 2006.

FIELD OF THE INVENTION

The invention relates to a method of using an impressed current cathodic protection (ICCP) system to provide power to one or more electrical appliances.

BACKGROUND OF THE INVENTION

Cathodic protection is commonly applied to protect marine, underground and other corrosion prone metal structures against corrosion. These structures may be water storage tanks, gas pipelines, oil platform supports, railtracks and many other metal facilities exposed to a corrosive environment.

If metal flowlines, pipelines, tanks or other metal structures are buried and/or submerged, soil and/or water conditions, such as salinity, conductivity and porosity have a corrosive effect on the structure causing it to loose metal to the surrounding soil or water. To inhibit this corrosion, metal structures may be protected against corrosion by the application of a sacrificial anode system in which a more active metal in the galvanic series than that of the structure is used as a sacrificial anode or by an Impressed Current Cathodic Protection (ICCP) system wherein a electric current is impressed on a buried anode (+), which drives the metal structure to a negative voltage relative to the environment.

The electric current for an ICCP system may be supplied by one or more transformer/rectifier devices, which may supply a direct current (DC) of up to 100 Amps at a voltage of below 1.3 Volt. The voltage is generally maintained below 1.3 Volt to inhibit formation of hydrogen in any water and/or hydrocarbons in the interior and/or exterior of the structure, since the formed hydrogen would also react with the metal of, and thereby cause hydrogen embrittlement of the structure.

It is known from U.S. Pat. No. 6,715,550 and European patent 1252416 to transfer a low voltage alternating current (AC) or Direct Current (DC) via a production tubing or casing in a well to one or more downhole electrical appliances.

However, thus far it has been considered unfeasible to use electrical energy at a voltage of below 1.3 Volt derived from an impressed current cathodic protection (ICCP) system to supply energy to one or more electrical appliances.

SUMMARY OF THE INVENTION

It is an object of the present invention to provide a method for tapping electrical energy from an electrically conductive structure, which is protected against corrosion by an impressed current cathodic protection (ICCP) system, such that one or more electrical appliances are fed with electrical energy tapped from the ICCP system. This avoids the use of (long) electrical cables or the use of a generator, solar cells, wind-driven dynamo's etc.

In accordance with the invention there is provided a method for using an impressed current cathodic protection (ICCP) system which supplies an electrical current such that a metallic structure has a negative voltage relative to earth to power one or more electrical appliances, the method comprising:

providing one or more electrical appliances which each have a pair of electrical contacts;

connecting one electrical contact of each electrical appliance to the structure; and connecting the other electrical contact of each electrical appliance to earth thereby providing electrical power to each of the electrical appliances.

The ICCP system may supply a DC electrical current to the metal structure with a voltage between 0.5 and 1.5 Volts and a current strength between 1 and 150 Ampere.

It is preferred that one or more electrical appliances comprise a DC-DC (Direct Current-Direct Current) power converter, which is adapted to convert electrical power if the voltage potential between the electrical contacts is between 0.5 and 1.5 Volt DC.

The DC-DC power converter preferably is of the switched capacitor type and performs as an electrical voltage amplifier, which generates an output voltage of between 3 and 5 Volt in response to the voltage potential of 0.5 and 1.5 Volts DC between the electrical contacts.

At least one electrical appliance may be provided with a rechargeable battery, which is configured to provide a start-up voltage below 500 mV DC.

The structure may be used to transmit uni-directional or bi-directional data by modulating the load current of the electrical energy transmitted via the structure, wherein the load current is modulated by means of a DC, FM, AM, pulse, chirp and/or ultrawideband load modulation technology.

The structure may form part of a steel or other metallic oil and/or gas production system and the data include sensor information, such as wellhead or downhole pressure in an oil and/or gas production well, temperature, fluid and/or sand flow, corrosion and/or cathodic protection voltages.

The steel or other metallic structure may comprise one or more steel pipelines which are located at or near the earth surface, such as an assembly of buried and/or underwater pipelines, a steel fluid storage vessel, an offshore oil and/or gas production platform and/or a railtrack.

A plurality of electrical appliances may be connected to the structure and the electrical power uptake of the appliances may be sequenced and controlled, such that the total electrical load on the impressed current cathodic protection system is maintained below a predetermined maximum.

These and other features, advantages and embodiments of the method according to the invention are described in the accompanying claims, abstract and the following detailed description of preferred embodiments of the method according to the invention, wherein reference is made to the accompanying drawings.

DETAILED DESCRIPTION OF THE FIGURES

Figure 1:
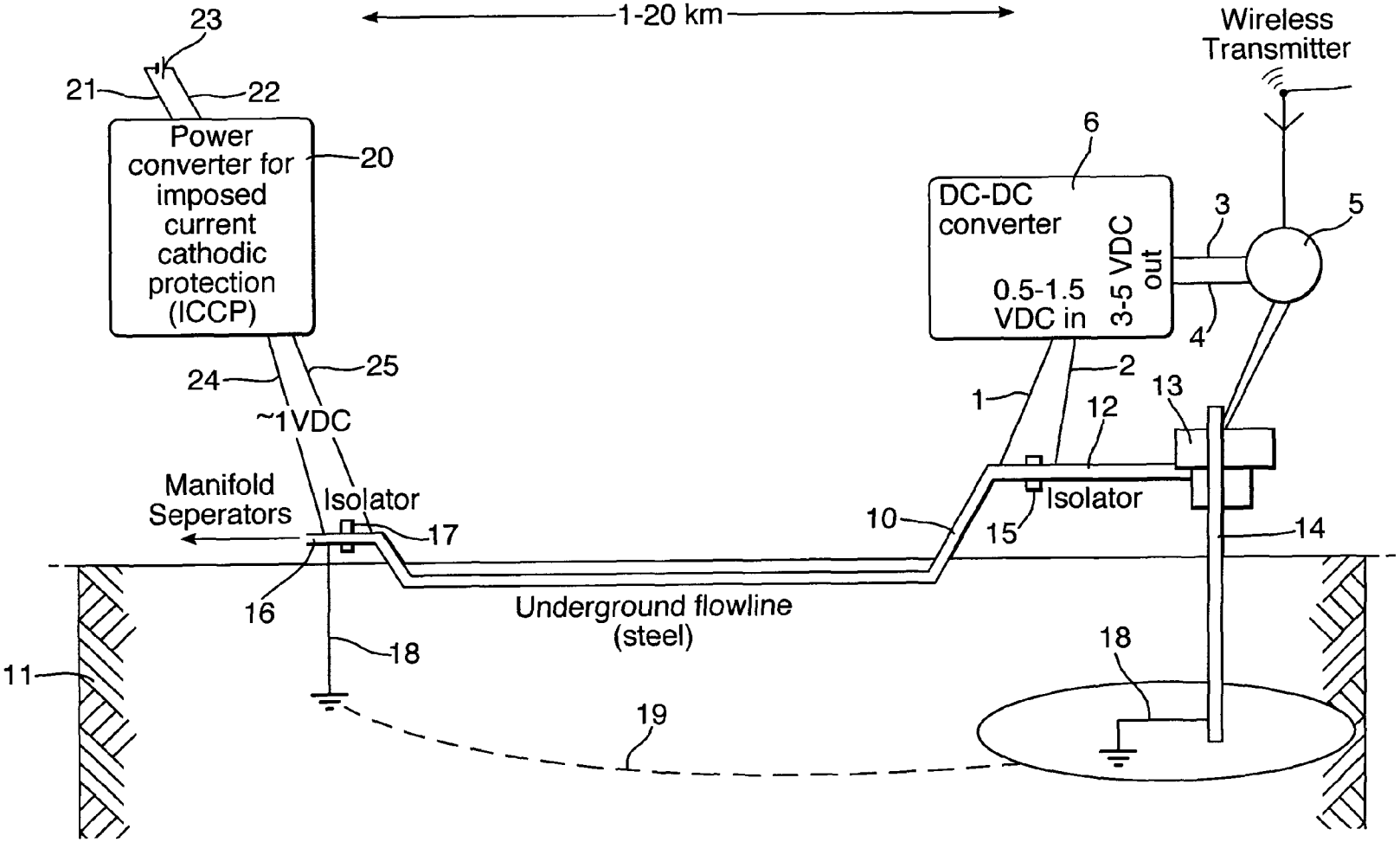
FIG. 1 schematically shows a buried metal pipeline, which is protected against corrosion by an impressed current cathodic protection (ICCP) system of which the impressed current is used to provide power via a DC-DC power converter to an electrical appliance.

FIG. 1 shows a steel pipeline 10 which is buried along a substantial part of its length into the earth 11 and which is at its upstream side connected to an outlet conduit 12 of a wellhead 13 of an oil and/or gas production well 14 by means of a first electrical isolator 15 and which is at its downstream side connected to an oil and/or gas processing and/or distribution facility 16 by a second electrical isolator 17. The well 14 and production facility 16 are each connected to earth 11 as illustrated by lines 18 and thereby electrically connected to each other via earth 11 as illustrated by the dashed line 19.

A power converter 20 for the Imposed Current Cathodic Protection (ICCP) system has a pair of input contacts 21 and 22 that are connected to an electrical power supply source 23, which may be an electrical power supply network and a pair of output contacts 24 and 25, of which one contact 24 is electrically connected to the facility 16 and the other contact 25 is electrically connected to the pipeline 10. Instead of connecting the contact 24 to the facility this contact 24 may be connected directly to earth 18. The ICCP power converter 20 is configured to supply an electrical direct current (DC) to the electrical output contacts 24 and 25 at an amperage which may exceed 100 Ampere, but such that the voltage between the contacts does not exceed 1.3 Volts so as to avoid hydrogen formation in the interior and exterior of the pipeline 10 that could create hydrogen embrittlement.

An electrical appliance 5 comprising a DC-DC power converter 6 is connected to the upstream end of the pipeline 10 and to the outlet conduit 12 of the wellhead 13 by means of a pair of electrical input contacts 1 and 2. The DC-DC power converter 6 is configured to boost the electrical voltage of the electrical power derived from the input contacts 1 and 2, such that if the voltage between the electrical input contacts 1 and 2 is between 0.5 and 1.5 Volt, the voltage between the electrical output contacts 3 and 4 of the DC-DC power converter 6 is between 3 and 5 Volt. This output voltage of between 3 and 5 Volt is sufficient to power a rechargeable battery and/or a pressure, temperature and/or other sensor at the wellhead 13 and to a wireless signal transmitter 7, which transmits data collected by the sensor to a control center (not shown). The electrical appliance 5 may comprise a voltage meter that monitors the voltage between the electrical input contacts 1 and 2 of the DC-DC power converter 6 and transmits the monitored voltage to the control center, from where the electrical current and/or voltage supplied by the ICCP power converter 20 may be adjusted in order to maintain the electrical voltage between the electrical input contacts 1 and 2 within the desired range of 0.5 to 1.5 Volt, more preferably between 0.7 and 1.1 Volt.

Figure 2:
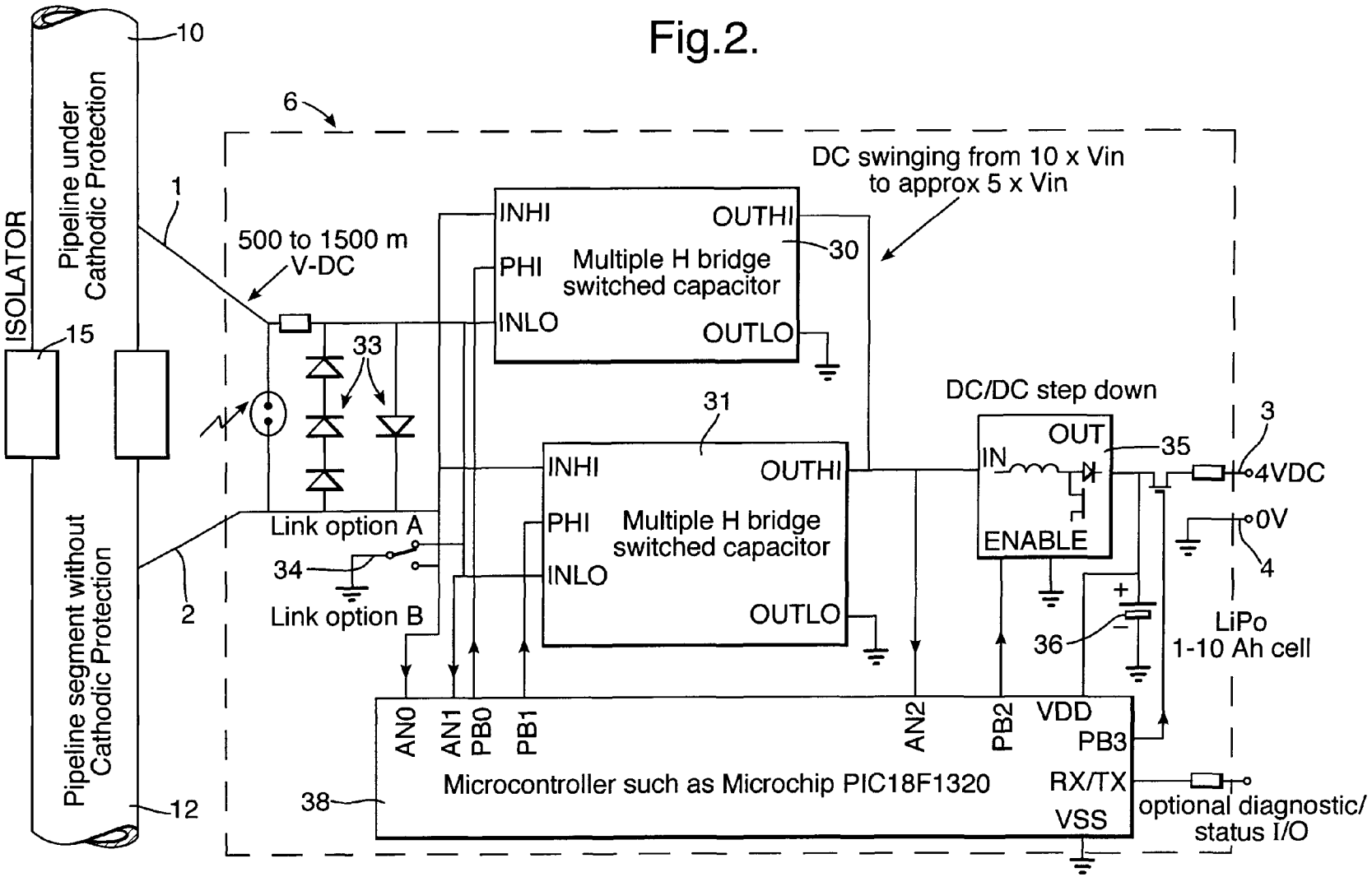
FIG. 2 shows an electrical scheme of a first embodiment of the DC-DC power converter shown in FIG. 1.

FIG. 2 shows an electrical scheme of a first embodiment of the DC-DC power converter 6. The electrical input contacts 1 and 2 of the converter 6 are connected to the pipeline 10 and to the outlet conduit 12 of the wellhead 13 that are interconnected by the first electrical isolator 15. The electrical input contacts 1 and 2 are connected to a pair of multiple H bridge switched capacitors 30 and 31, which are controlled by a microcontroller 38, such as a microchip PIC18F1320. The multiple H bridge switched capacitors 30 and 31 are arranged in the illustrated electrical scheme, which furthermore comprises a series of diodes 33, a mode selection switch 34, a DC-DC step down converter 35 and a rechargeable battery 36 comprising a LiPo 1-10 Ah cell, which is configured to provide a start up voltage of below 500 mV-DC. The microcontroller 38 and other components of the DC-DC power converter control the Multiple H bridge switched capacitors 30 and 31 such that between the electrical output contacts 3 and 4 of the DC-DC power converter 6 a voltage is created of between 3 and 5 Volt.

Figure 3:
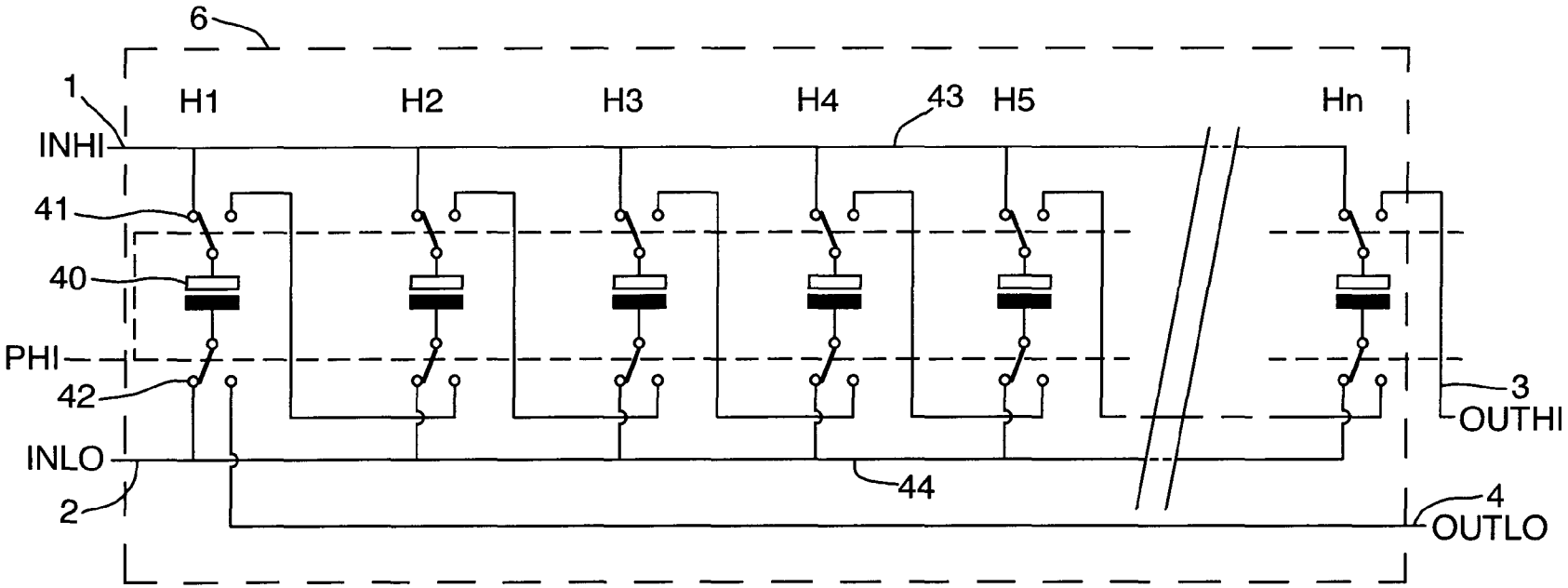
FIG. 3 shows an electrical scheme of a second embodiment of the DC-DC power converter shown in FIG. 1.

FIG. 3 shows an alternative embodiment of the DC-DC power converter 6, wherein the converter 6 comprises a series of n H bridge switched capacitors H1, H2, H3, H4, H5, Hn, and n typically is 10. Each switched capacitor H1-Hn comprises a capacitor 40 that is arranged between an upper switch 41 and a lower switch 42. The upper switch 41 of each capacitor Hn has one contact that is connected to an upper electrical conduit 43 and another contact that is connected to a contact of a lower switch 42 of a subsequent capacitor Hn+1, such that the capacitors H1-Hn can be connected in series thereby boosting the electrical voltage such that if the electrical voltage between the electrical input contacts 1 and 2 is between 0.5 and 1.5 Volt the voltage between the output contacts of the DC-DC power converter is between 3 and 5 Volt.

That which is claimed is:

1. A method for using an impressed current cathodic protection (ICCP) system which supplies an electrical current such that a metallic structure has a negative voltage relative to earth to power one or more electrical appliances, the method comprising:

providing one or more electrical appliances which each have a pair of electrical contacts;

connecting one electrical contact of each electrical appliance to the structure; and connecting the other electrical contact of each electrical appliance to earth thereby providing electrical power to each of the electrical appliances wherein the electrical appliances are selected from the group consisting of wellhead pressure sensors, downhole pressure sensors, temperature sensors, and fluid and/or sand flow sensors.

2. The method of claim 1, wherein one or more electrical appliances comprise a DC-DC (Direct Current-Direct Current) power converter, which is adapted to convert electrical power if the voltage potential between the electrical contacts is between 0.5 and 1.5 Volt DC.

3. The method of claim 2, wherein the DC-DC power converter comprises an electrical voltage amplifier, which generates an output voltage of between 3 and 5 Volt in response to the voltage potential of 0.5 and 1.5 Volts DC between the electrical contacts.

4. The method of claim 1, wherein a DC electrical current is supplied to the metal structure with a voltage between 0.5 and 1.5 Volts and a current strength between 1 and 150 Ampere.

5. The method of claim 1, wherein at least one electrical appliance is provided with a rechargeable battery, which is configured to provide a start-up voltage below 500 mV DC.

6. The method of claim 1, wherein the structure is used to transmit data by modulating the load current of the electrical energy transmitted via the structure.

7. The method of claim 6, wherein the load current is modulated by means of a DC, FM, AM, pulse, chirp and/or ultrawideband load modulation technology.

8. The method of claim 6, wherein the structure forms part of an oil and/or gas production system and the data include sensor information.

9. The method of claim 1, wherein the structure is a steel structure, comprising one or more steel pipelines which are located at or near the earth surface.

10. The method of claim 1, wherein a plurality of electrical appliances are connected to the structure and the electrical power uptake of the appliances is sequenced and controlled, such that the total electrical load on the impressed current cathodic protection system is maintained below a predetermined maximum.

* * * * *